US005096438A

United States Patent [19]

Black

[11] Patent Number: 5,096,438

[45] Date of Patent: Mar. 17, 1992

[54] ELECTRICAL DISTRIBUTION LINE CONTROL STICKS

[76] Inventor: Larry K. Black, 1249 Smith Cove Circle, Virginia Beach, Va. 23455

[21] Appl. No.: 544,947

[22] Filed: Jun. 28, 1990

[51] Int. Cl.[5] ..... H01R 13/00

[52] U.S. Cl. ..... 439/478; 200/48 R; 294/19.1

[58] Field of Search ..... 439/477–480, 439/483, 481, 514, 515, 509, 621, 622; 200/48, 49, 51; 337/171, 2, 4; 294/19.1, 19.2

[56] References Cited

U.S. PATENT DOCUMENTS

| | | | |
|---|---|---|---|
| 1,594,925 | 8/1926 | Chandler . | |
| 1,990,928 | 2/1935 | Bodendieck . | |
| 2,128,019 | 8/1938 | Sleeper . | |
| 2,233,826 | 3/1941 | Allison . | |
| 2,438,746 | 3/1948 | Garrison . | |
| 2,508,778 | 5/1950 | Spears | 439/479 |
| 2,606,949 | 8/1952 | Kojis | 439/480 |
| 2,761,039 | 8/1956 | Smith . | |
| 2,821,690 | 1/1958 | Miller | 439/478 |
| 2,864,071 | 12/1958 | Johnson, Jr. . | |
| 3,026,391 | 3/1962 | Bridges et al. | 439/477 |
| 3,173,998 | 3/1965 | Deuser . | |
| 3,193,765 | 7/1965 | Bevins . | |
| 3,666,311 | 5/1972 | McMullin . | |
| 3,788,691 | 1/1974 | McMullin . | |
| 3,863,145 | 1/1975 | Kelly et al. | 439/477 |
| 3,868,136 | 2/1975 | Shweitzer, Jr. . | |
| 4,582,352 | 4/1986 | Filter et al. . | |
| 4,583,043 | 4/1986 | Phillips . | |
| 4,688,013 | 8/1987 | Nishikawa | 200/49 |

*Primary Examiner*—David L. Pirlot
*Attorney, Agent, or Firm*—Cushman, Darby & Cushman

[57] ABSTRACT

The invention is an apparatus for connecting and disconnecting an unenergized electrical line relative to an energized electrical line. It includes first and second connector devices, each including an electrically non-conductive member having a manipulatable hook positioned at one end. A fuse is electrically connected between the first and second connector hooks for electrically disconnecting the first connector hook from the second connector hook in the event of an excessive current demand through the connector hooks. A remotely operable switch is eletrically connected between the first and second connector hooks for electrically connecting and disconnecting the first connector hook relative to the second connector hook.

14 Claims, 2 Drawing Sheets

ELECTRICAL DISTRIBUTION LINE CONTROL STICKS

FIELD OF THE INVENTION

The present invention relates to a device for connecting an unenergized electrical distribution line relative to an energized electrical distribution line, or for disconnecting these lines, particularly in high voltage power distribution systems.

BACKGROUND OF THE INVENTION

When testing or repairing electrical power line distribution systems, it is often necessary to disconnect and reconnect an unenergized (cold) line from an energized (hot) line. Directly disconnecting a high voltage (generally, above 600 volts) hot line from a cold line will result in considerable arcing between the two lines when the connection is broken. This arcing is extremely dangerous and frequently creates sparks which are equally dangerous. The sparks are very hot, they can burn, and an associated flash is very bright and can blind or damage the eyes. Thus, at high voltages, it is necessary to handle the lines from a distance with special sticks to provide safe working conditions between the operator and the lines.

The arcing can also be destructive as it will melt, weld or otherwise destroy equipment. Furthermore, if the arc goes to ground or cross-phase, it is possible that an entire power loop will fail, resulting in a power outage for many customers. Thus, it is desirable to maintain a controllable electrical connection between a hot line and a cold line while they are physically being disconnected from one another. After the lines are separated, the electrical connection can be broken. This prevents arcing between the hot and cold lines. Inversely, it is desirable to first electrically connect separated hot and cold lines before physically connecting them together to prevent arcing as the lines are brought together.

A conventional portable vacuum switch, often called a Rabbit Box, has been used to connect and disconnect hot and cold lines. However, such a vacuum switch requires a considerable amount of covering insulating material in order to make it available to use in a transformer box. Further, these portable vacuum switches require 4–5 people to properly operate them and their use is not very time efficient. An additional concern is that use of these portable vacuum switches is not considered to be particularly safe. Because of these problems, it is often easier to simply deenergize an entire circuit loop prior to undertaking work on the distribution systems. This is undesirable as it interrupts service to everyone on the circuit loop.

SUMMARY OF THE INVENTION

The present invention has been designed to minimize the problems discussed above. The invention employs a pair of conventional electrical line control sticks. These control sticks are electrically nonconductive elongated sticks with hooks at one end of each stick. Such control sticks are used individually for remotely manipulating energized electrical distribution components, thereby protecting an operator from electrical shock. The control sticks have been modified to include a fuse mechanism and a remotely operable vacuum switch, mounted to one of the sticks, respectively.

Conventionally, the control sticks are used individually and are not interconnected. In the present invention, remotely manipulatable hooks positioned on the end of each control stick are electrically connected through an electric line that includes the fuse and the remotely operable vacuum switch. The vacuum switch is used to open and close the electrical connection between the two hooks, when it is desired to do so. The fuse opens the electrical connection if an excessive current is drawn through the hooks and triggers that response.

Each control stick is easily manipulated by a single individual and allows a hot line and a cold line to be physically connected and disconnected from each other while being electrically connected and disconnected remotely within the vacuum switch. Thus, the present invention can be used to physically disconnect a hot line from a cold line while the hot line remains electrically connected or energized. When the hot and cold lines are separated enough to prevent arcing between those lines, the vacuum switch is remotely opened to electrically disconnect the two lines. Any arcing is safely contained inside the enclosed vacuum switch.

The present invention is also used in an inverse way to prevent arcing between the lines when physically connecting a hot and cold line. One control stick is connected to the cold line and the other control stick to the separated hot line while the vacuum switch is open. The switch is then closed, bringing both lines to the same electrical potential whereupon the two lines can be physically connected without electrical arcing.

In one embodiment of the present invention, a rotating collar and electrical coupling allow one of the control sticks to be rotated relative to the fuse or vacuum switch, thereby easing the task of physically connecting and disconnecting electrical connectors which screw together.

With the foregoing in mind, other objects, features and advantages of the present invention will become more apparent upon consideration of the following description and the appended claims with reference to the accompanying drawings, all of which form part of this specification, wherein like reference numerals designate corresponding parts in the various figures.

DETAILED DESCRIPTION OF THE PRESENTLY PREFERRED EXEMPLARY EMBODIMENT

Figure 1:
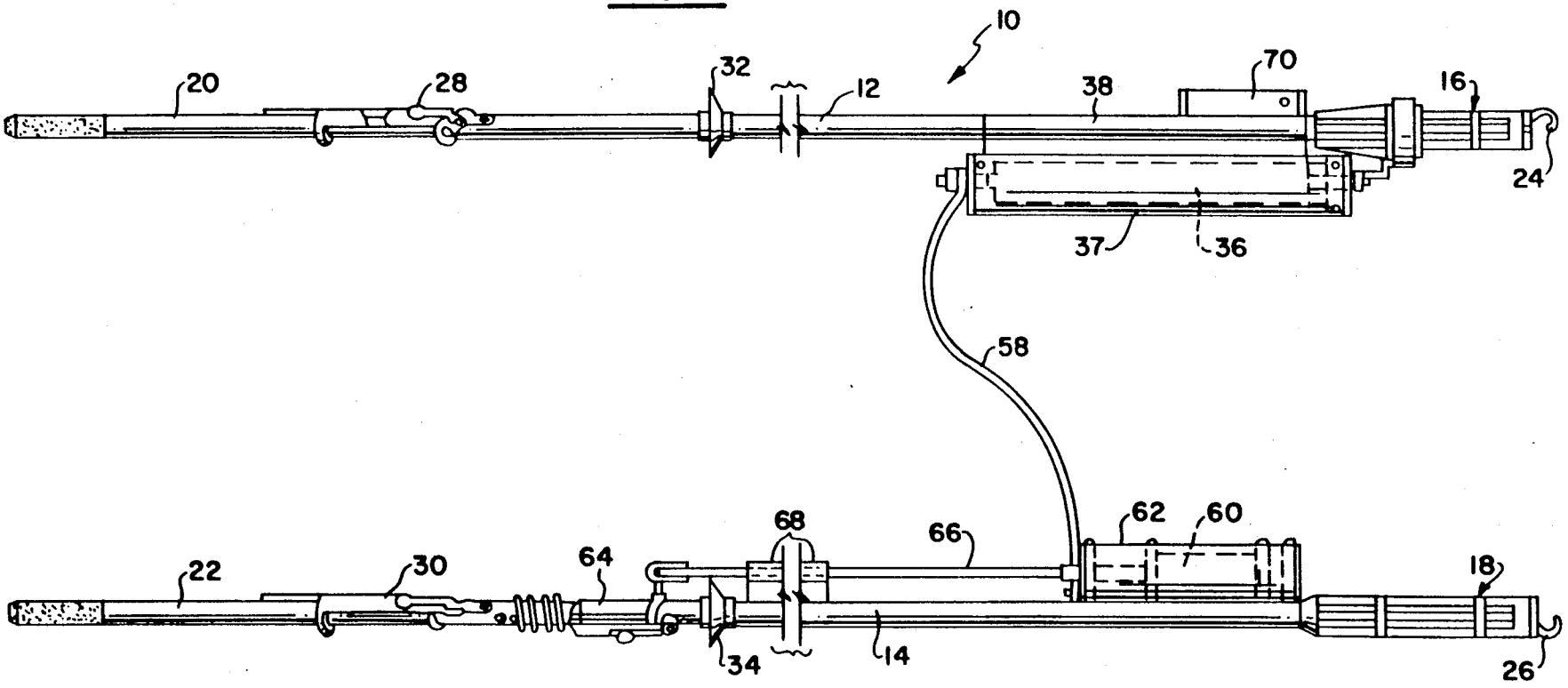
FIG. 1 is a perspective view of a pair of electric line control sticks according to the present invention.

FIG. 1 shows a pair of electric line control sticks, generally indicated at 10, according to the presently preferred embodiment of the present invention. The individual sticks, 12 and 14, are constructed of electrically nonconductive materials such as, for example, plastic, fiberglass or wood and can be 7–8 feet long with a diameter of approximately 1.25 inches. Each stick 12 and 14 has a hook end 16 and 18, respectively, and a grasping end 20 and 22, respectively.

Hook end 16 comprises an outer housing 17. An actuating handle 28 is operatively attached at a convenient position on the lower grasping end 20 of stick 12 and is movable between open and closed positions. Handle 28 is attached to a rod 25, constructed of an electrically nonconductive material. Rod 25 extends through a hollow interior passageway 19, shown in phantom in FIG. 2, which itself extends axially through the interior of stick 12. Handle 28 is connected to one end of rod 25 by a pivotal and cam type of mechanism that causes the rod 25 to be moved axially within stick 12 as the handle is moved between its open and closed positions. Specifically, when handle 28 is closed, rod 25 is in its most outwardly extended position and conversely, when handle 28 is open, rod 25 is in its most inwardly retracted position.

Figure 2:
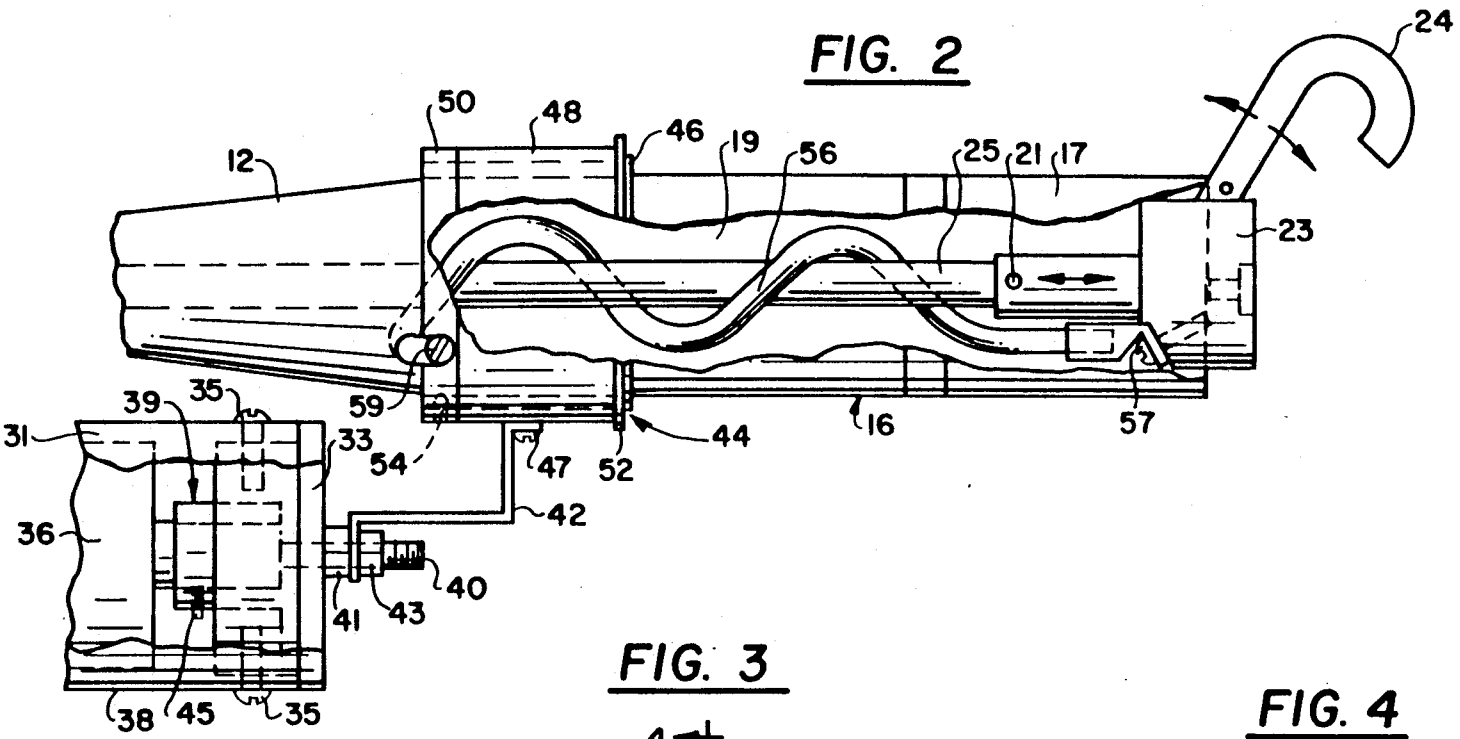
FIG. 2 is a cut-away detail view of one end of one of the control sticks.

The other end of rod 25 is connected by a pin 21 to a lower portion of a reciprocating block member 23 that is slidably retained within the outer end of member 17. As shown in FIG. 2, member 17 can be a cylindrically shaped member having a hollow end portion in which member 23 is received. A hook 24 is pivotably attached to member 23 and a spring (not shown) is provided internally within member 23 to hold hook 24 in a normally open position as shown in full line in FIG. 2.

As member 23 is pulled into housing 17 the exterior edge of hook 24 will engage the edge of housing 17 and be pivoted into a closed position.

The assembly on hook end 18 to actuate hook 26 is similarly configured just to that described for stick 12 and further description is not deemed to be necessary. Hook 26 is itself actuated by handle 30.

Handles 28 and 30 open and close hooks 24 and 26, respectively, for gripping electrical connectors, as will be described later. Shields 32 and 34 are positioned to prevent an operator from gripping the sticks too close to the hot electrical lines that are to be manipulated by the sticks.

Hook 24 is also electrically connected to reciprocating block member 23 which is in turn physically and electrically connected by screw 57 to one end of a jumper lead 56 located within housing 17. The other end of jumper lead 56 is physically and electrically connected to a coupling member, generally indicated at 44, by a screw 59.

Figure 4:
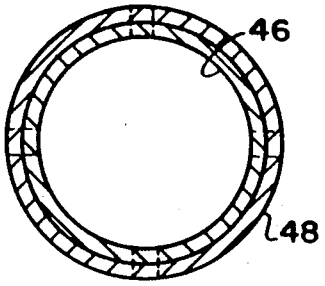
FIG. 4 is a sectional view along line 4—4.
Figure 3:
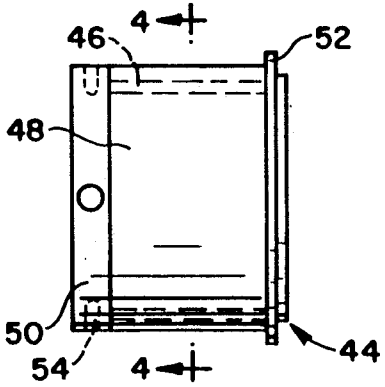
FIG. 3 is a perspective view of a rotating collar.

Coupling member 44 has an inner sleeve 46, which is an extension of housing 17, electrically connected to an outer sleeve 48 as can best be seen in FIGS. 2–4. The outer sleeve 48 is positioned between a flange 50 of inner sleeve 46 and a snap-ring 52 which engages a groove (unshown) in the inner sleeve 46. The clearances between the inner sleeve 46 and outer sleeve 48 are determined by the desired degree of fit. In one embodiment, an electrically conductive grease can be used between the two sleeves although this can be omitted if desired. The inner sleeve 46 is fixedly mounted to the stick 12 by a plurality of set screws 54 threaded through the flange 50. The outer sleeve 48 on the other hand, is rotatable in relation to the inner sleeve 46 and stick 12. The outer sleeve 48 is physically and electrically connected to a jumper strap 42 by a screw 47 which does not extend through to the inner sleeve 46. This permits stick 12 to be rotated independently of the rotatably mounted fuse 36 and casing 37. In one embodiment, the coupling member 44 is made of brass but it can be made of aluminum or any other conductive material.

Jumper strap 42 is physically and electrically connected to a connector generally indicated at 39 and which comprises post 40, locking nuts 41 and 43 and set screw 45. Connector 39 is physically and electrically connected to one end of a fuse 36 by the set screw 45. Fuse 36 and a portion of connector 39 are encased in a protective electrically nonconductive casing, generally indicated at 37. Only locking nuts 41 and 43 and a portion of the post 40 extend outside casing 37. In one embodiment, casing 37 comprises a plexiglass tube 31 attached to a plexiglass end cap 33 by nylon screws 35.

The other end of fuse 36 is physically and electrically connected to one end of a second jumper lead 58 in a convenient manner. The second jumper lead 58 is for example 3 feet long and its other end is electrically connected to one terminal of a vacuum switch 60 encased in an electrically nonconductive switch casing 62 mounted to the second stick 14. The nonconductive switch casing 62 insulates and protects vacuum switch 60 which is conventionally designed and is totally enclosed. The vacuum switch includes an internal vacuum chamber in which any arcing is contained, thereby reducing hazards associated with an open arc condition. In one embodiment, an appropriately rated vacuum switch made by the Jennings Company is used.

The other terminal of the vacuum switch 60 is electrically connected to hook 26 by a third jumper lead (unshown) that is similar to lead 56. In one embodiment, the vacuum switch 60 can be electrically connected by a jumper lead to hook 26 similarly to coupling 44 being connected to hook 24 by jumper lead 56. The vacuum switch 60 is opened and closed by means of a remote actuating control switch 64 and actuating rod 66. A portion of the actuating rod 66 is enclosed in an electrically nonconductive shield 68 attached to the stick 14 to prevent unwanted actuation of the vacuum switch 60 in the event that the actuating rod 66 is bumped. The shield 68 can be U-shaped, surrounding actuating rod 66 with the open ends connected to the stick 14. Alternatively, the shield 68 could comprise a tube surrounding the actuating rod 66 with the tube attached to the stick 14 by a bridging web. The sticks can be counterweighted to balance the weight of the fuse 36 and vacuum switch 60.

Hooks 24 and 26 are remotely manipulatable to grip and operate two types of electrical connectors encountered in a transformer box. Thus, the hooks 24 and 26 are used both to establish electrical circuits and to physically operate different types of electrical connectors. The first type of connector is found in a dead-front transformer. To disconnect this type of connector, one of the hooks 24, 26 is engaged with a ring on the end of the connector and the connector can be disconnected by merely pulling a ring connector from a connector socket and connected by pushing the ring connector into the ring socket.

For a second type of connector found in live-front transformers, the connector must be rotated to disconnect it. By means of the rotating coupling 44 and the rotating collar 38, stick 12 is specifically adapted for rotating a live-front connector. A ring on the connector is engaged by the hook 24 and stick 12 is rotated to disconnect or connect the connector. The fuse 36 and casing 37 are maintained in a stationary position by gravity as the stick 12 is rotated. This prevents the second jumper lead 58 from wrapping around stick 12 as it is rotated. In an alternative embodiment, the second jumper lead 58 can be long enough to rotate about stick 12 if fuse 36 is not attached to a rotating collar and coupling. A voltage verifier 70 can be provided on one of the sticks to notify whether a voltage is present, i.e., whether a line is hot or cold, the vacuum switch 60 is open or closed, and whether the fuse 36 is good or blown. In a preferred embodiment, the voltage verifier 70 is of conventional design and is physically attached to the rotating collar 38 and is electrically attached by a jumper lead (not shown) to the outer sleeve 48.

In one representative embodiment of the present invention, sticks 12 and 14 are about 7' 10" long and 1.25" in diameter Casing 37 is about 18" long and 2.5" in diameter while casing 62 is about 10" long and 2.5" in diameter. Coupling 44 is about 2" long with inner sleeve 46 having an inner diameter of 2" and an outer diameter of 2.125". Outer sleeve 48 has an inner diameter of approximately 2.128", allowing for clearance between the inner sleeve 46 and the outer sleeve 48 depending on the degree of fit desired between the two pieces. Shield 32 is positioned, for example, 29" from the jumper lead 58 end of casing 37 and shield 34 is similarly positioned. Shield 68 is approximately 22" long.

The procedure for using the present invention to connect a hot line to a cold line is as follows. Each stick 12 and 14 is individually manipulated by a separate operator to assure that ends 20 and 22 will not be simultaneously held by a single operator thus completing an undesirable circuit through that operator. Additionally, each operator will wear appropriate protective clothing, such as rubber gloves and sleeves, and appropriate shielding material will be positioned in and around the transformer box.

The continuity between hooks 24 and 26 is first checked with a continuity tester with the vacuum switch 60 open and then closed. This checks whether the vacuum switch 60 is operating properly and whether the fuse 36 is operational. If everything is working properly, the vacuum switch 60 is opened. Stick 14 is attached to the hot line while stick 12 is held away from the cold line. The vacuum switch 60 is closed and the continuity is again checked by means of the voltage verifier 70 to reconfirm that the vacuum switch 60 is still operating properly and that fuse 36 has not blown after exposure to the high voltage. Vacuum switch 60 is then opened and continuity again checked to make sure that the switch 60 has electrically isolated hook 24 from the hot line.

With the vacuum switch 60 open, stick 12 is attached to the cold line. Vacuum switch 60 is then closed to energize the cold line. If the fuse 36 blows, the cold line has a fault in it. If the fuse 36 does not blow, the cold line is good. Thus, fuse 36 tests whether the cold line is good or not and is also a safety device, cutting current to a bad line. The voltage verifier 70 is used to determine whether the fuse 36 has blown or not. If the voltage verifier 70 indicates a voltage, the fuse 36 has not blown and the cold line has been energized. If the voltage verifier 70 indicates no voltage, either the fuse 36 has blown or the voltage verifier 70 is not operating properly. Either case will require further investigation by the operator.

If the cold line has remained energized, the hot line and cold line are physically attached to each other. The switch 60 is then opened, the fuse stick 12 removed and held clear. Finally, the stick portion 14 is removed. The present invention is used in a similar manner to disconnect a hot line from a cold line.

While the invention has been described in accordance with what is presently conceived to be the most practical and preferred embodiment, it is to be understood that the invention is not to be limited to the disclosed embodiment but on the contrary, is intended to cover various modifications and equivalent arrangements included within the spirit and the scope of the appended claims, which scope is to be accorded the broadest interpretation of such claims so as to encompass all such equivalent structures.

I claim:

1. An apparatus for connecting and disconnecting unenergized and energized electrical lines comprising:

first and second connector devices, each including an electrically non-conductive member having a manipulatable line engaging portion positioned at one end of said member;

an electrical connection provided between the first and second connector devices, said electrical connection including fuse means for electrically disconnecting the first line engaging portion from the second line engaging portion in the event of an excessive current demand through the line engaging portions;

said electrical connection further including remotely operable switch means for electrically connecting and disconnecting the first line engaging portion relative to the second line engaging portion;

the first connector device including a first coupling mounted thereon and electrically connected to the line engaging portion thereon and the second connector device including a second coupling mounted thereon and electrically connected to the line engaging portion thereon; and at least one of the first coupling and the second coupling comprising a first sleeve and a second sleeve such that the first sleeve is rotatable in relation to the second sleeve and the first sleeve and second sleeve are electrically connected, one of the first sleeve and the second sleeve being mounted to the connector device and the other of the first sleeve and the second sleeve being mounted to one of the fuse means and the switch means.

2. The apparatus of claim 1 wherein the first line engaging portion is electrically connected in series to the first sleeve, second sleeve, fuse means, switch means, second coupling, and second line engaging portion.

3. The apparatus of claim 1 wherein the fuse means is rotatable mounted to the first connector device so that the non-conductive member may be rotated relative to the fuse means.

4. The apparatus of claim 1 wherein the switch means is rotatably mounted to the second connector device so that the non-conductive member may be rotated relative to the switch means.

5. The apparatus of claim 1 including means for determining whether an electrical line is energized.

6. The apparatus of claim 1 including hand shields mounted to the non-conductive members to maintain a desired distance between grasping positions of the non-conductive members and the line engaging portions.

7. The apparatus of claim 1 wherein at least one of the line engaging portions comprises a hook.

8. The apparatus of claim 1 wherein the switch means is a vacuum switch.

9. The apparatus of claim 8 wherein the remotely operable switch means comprises an actuating rod attached at one end to the vacuum switch and at another end to an actuating switch.

10. The apparatus of claim 9 wherein the actuating rod is at least partially surrounded by a shield attached to the non-conductive member.

11. The apparatus of claim 1 wherein the line engaging portions are manipulatable by remote activating devices.

12. The apparatus of claim 11 wherein the remote actuating devices are electrically isolated from the line engaging portions.

13. The apparatus of claim 9 wherein the actuating switch can lock the switch means in an open and in a closed position.

14. The apparatus of claim 13 wherein the remote actuating switch is electrically isolated from the switch means.

* * * * *